US010863835B2

(12) United States Patent
Ramos-Gonzales

(10) Patent No.: US 10,863,835 B2
(45) Date of Patent: Dec. 15, 2020

(54) MOUNTING SYSTEM AND METHOD FOR ARTWORK

(71) Applicant: Innova Art Ltd, Harlow (GB)

(72) Inventor: Michael Ramos-Gonzales, Harlow (GB)

(73) Assignee: Innova Art Ltd., Essex (GB)

( * ) Notice: Subject to any disclaimer, the term of this patent is extended or adjusted under 35 U.S.C. 154(b) by 318 days.

(21) Appl. No.: 16/089,971

(22) PCT Filed: Mar. 15, 2017

(86) PCT No.: PCT/GB2017/000033

§ 371 (c)(1),
(2) Date: Sep. 28, 2018

(87) PCT Pub. No.: WO2017/168115

PCT Pub. Date: Oct. 5, 2017

(65) Prior Publication Data

US 2020/0305616 A1 Oct. 1, 2020

(30) Foreign Application Priority Data

Mar. 29, 2016 (GB) ..... 1605215.1

(51) Int. Cl.
*A47G 1/06* (2006.01)
*A47G 1/16* (2006.01)

(52) U.S. Cl.
CPC ..... *A47G 1/0633* (2013.01); *A47G 1/162* (2013.01)

(58) Field of Classification Search
None
See application file for complete search history.

(56) References Cited

U.S. PATENT DOCUMENTS 796,310 A * 8/1905 Fisher ..... A47G 1/0633 40/786
868,627 A * 10/1907 Fairchild ..... A47G 1/0633 40/786
1,062,710 A * 5/1913 Hookwin et al. .... A47G 1/0633 40/786

(Continued)

FOREIGN PATENT DOCUMENTS

DE 9312623 U1 * 12/1993 ..... A47G 1/0633
JP 50035595 U * 4/1975 ..... A47G 1/06
JP S5118952 Y1 * 5/1976 ..... A47G 1/06

*Primary Examiner* — Cassandra Davis
(74) *Attorney, Agent, or Firm* — Blank Rome LLP

(57) ABSTRACT

A mounting system (1) for artwork is disclosed, comprising a blank (3) of planar material, comprising a rectangular main section (7) for carrying artwork, which has first and second integral tabs (9) extending from respective opposite sides of the main section and which are foldable into a three dimensional box-like shape behind the main section to provide first and second perimeter members. The system also comprises third and fourth integral foldable tabs (11) extending from the remaining sides of the main section and which project outwards by a lesser extent than the first and second tabs. The system also comprises a plurality of separate extender tabs (5) for attachment to the third and fourth foldable tabs to permit said tabs to be folded in a likewise manner to form third and fourth perimeter members behind the main section.

14 Claims, 8 Drawing Sheets

(56) References Cited

U.S. PATENT DOCUMENTS

| | | | | | |
|---|---|---|---|---|---|
| 1,472,355 | A * | 10/1923 | Dietsche, Jr. | G09F 1/04 | 40/786 |
| 1,515,338 | A * | 11/1924 | Carter | G09F 1/04 | 40/786 |
| 2,772,499 | A * | 12/1956 | Ferrucci | A47G 1/0633 | 40/786 |
| 2013/0227868 | A1 * | 9/2013 | Edmondson | A47G 1/0633 | 40/743 |

* cited by examiner (a)

(b)

MOUNTING SYSTEM AND METHOD FOR ARTWORK

CROSS-REFERENCE TO RELATED APPLICATIONS

This application is a national stage application that is based on and claims the benefit of International Application PCT/GB2017/000033, filed Mar. 15, 2017, entitled "Mounting System & Method For Artwork," which is based on and claims the benefit of priority of GB Patent Application GB 1605215.1, filed Mar. 29, 2016, both of which are incorporated herein by reference in their entirety.

FIELD OF THE INVENTION

This invention relates to a mounting system and method for artwork.

BACKGROUND OF THE INVENTION

Canvas art is a popular artwork medium. Artwork is printed onto a stretchable canvas or canvas-type medium, which is stretched over, and fixed to, an underlying frame assembly made up of stretchers; the stretchers hold the canvas under tension to give a professional finish. The stretchers are usually hidden behind the artwork.

An alternative mounting system is disclosed in, for example, WO2011/010085 which provides a mount system in the form of a blank of cardboard, or similar foldable material, with a central image-carrying area. Extending from each of the four sides is an integral tab with parallel fold lines, providing an overall cruciform shape. A significant part of the rear surface is coated with pressure adhesive, covered with a peel-off liner. After the art has been printed onto the front surface of the blank, the liner is removed from the rear surface and the mounting system is partially completed by folding each tab backwards into a box-shape to form a perimeter member. The four perimeter members are adhered to the rear of the image-carrying area to form a complete frame. Finally, a box-shaped stiffening element is located inside the rear space between the perimeter members, and adhered to the rear surface to provide an overall, rigid structure for wall hanging.

There are several disadvantages with this system. First, printers and coating machines are limited in terms of the width of blank they can accept. The presence of tabs enlarges the overall blank width and hence this form of mounting system places limitations on the artwork size that can be printed. Also, a relatively large amount of adhesive is required to fix into position the tabs and the stiffening element.

It is an aim to provide an improved mounting system and method.

SUMMARY OF THE INVENTION

A first aspect of the invention provides a mounting system for artwork, the system comprising:

- a blank of planar material, comprising a main section for carrying artwork; and
- a plurality of separate extender tabs for attachment to respective sides of the blank, each extender tab being longitudinal and having a plurality of parallel fold lines along its length to enable the tab to be folded into a three-dimensional perimeter member and fixed behind the main section of the blank.

The blank main section may be rectangular and further comprises, on each of first and second opposite sides of the main section, an integrally formed longitudinal tab extending outwardly from said main section by a dimension W and having a plurality of parallel fold lines to enable the tab to be folded into a three dimensional perimeter member and fixed behind the main section of the blank, and wherein the separate extender tabs are arranged to be attached to the third and fourth opposite sides.

The blank main section may further comprise, on each of the third and fourth opposite sides, an integrally formed longitudinal tab having at least one foldable section to which one of the extender tabs can be attached, the extender tabs each having a corresponding extension dimension w, where $w<W$.

The third and fourth integral side tabs may comprise a first foldable section integrally connected to the main section, and a second foldable section integrally connected to the first foldable section to which one of the extender tabs can be attached.

The first and second side integral tabs may each comprise four fold lines defining four fold sections to enable folding of the tab into a box-like perimeter member, with a substantially rectangular cross section, the fourth fold section being generally parallel with the blank main section.

The separate extender tabs may each comprise two fold lines defining three foldable sections, a first one of the foldable sections being arranged to attach to the foldable section of one of the third and fourth integrally formed tabs.

A second, central one of the three foldable sections may comprise one or more push-out tabs defined by partial cuts made through, or substantially through, the material of said foldable material so that relative folding between the second and third sections results in the push-out tab(s) projecting outwards.

One side of each separate extender tab may carry an adhesive, e.g. a pressure adhesive.

The adhesive may be provided at least on the first foldable part and the push-out tabs.

The adhesive may further be provided on the parts of the second foldable section which are either side of the push-out tabs.

The second foldable sections of each of the tabs may comprise a hole, arranged such that the holes of adjacent tabs overlie one another when the tabs are folded into their three-dimensional shapes.

The system may further comprise a pin, plug or the like dimensioned and arranged to friction fit within the overlying holes to retain all four perimeter members in place.

The system may further comprise a stiffening element provided in the form of a blank of card with a main, central rectangular section and four perimeter fold tabs, arranged to locate in a friction fit within the void between the four perimeter members.

A second aspect of the invention provides a mounting system for artwork, comprising:

- a blank of planar material, comprising a rectangular main section for carrying artwork, first and second integral tabs extending from respective sides of the main section and which are foldable into a three dimensional box-like shape behind the main section to provide first and second perimeter members, and third and fourth integral foldable tabs extending from the remaining sides of the main section and which project outwards by a lesser extent than the first and second tabs; and
- a plurality of separate extender tabs for attachment to the third and fourth foldable tabs to permit said tabs to be folded in a likewise manner to form third and fourth perimeter members behind the main section.

The separate extender tabs may carry on one side a layer of pressure adhesive for fixing said tabs to the rear of the main section.

In any of the above definitions, adhesive may only be provided on the extender tabs.

A further aspect of the invention provides a method of constructing a mounting system for artwork having the features of any preceding definition, the method comprising applying an artwork to the blank main section, attaching the extender tabs to respective sides of the blank, and folding the extender tabs into a three-dimensional perimeter member behind the main section.

A further aspect of the invention provides a method of constructing a mounting system for artwork having the features of any above definition, the method comprising: applying an artwork to the blank section; folding each of the first and second integral tabs backwards to form a three dimensional, box-like shape behind the main section; attaching the extender tabs to the third and fourth foldable tabs, e.g. using adhesive; and folding combined tabs backwards to form a three dimensional, box-like shape behind the main section.

Various other preferred features are given in the detailed description below. For example, the material used for the blank and/or extending members may be paper, card, laminate or indeed any material on which art is conventionally mounted.

BRIEF DESCRIPTION OF THE DRAWINGS

The invention will now be described, by way of non-limiting example, with reference to the accompanying drawings, in which.

DETAILED DESCRIPTION OF PREFERRED EMBODIMENTS

Preferred embodiments described herein provide an artwork mounting system applicable to all types of artworks, including art prints and photographs. Embodiments are particularly suited to art that is digitally printed/coated, e.g. using AQ or UV coating.

Figure 1:
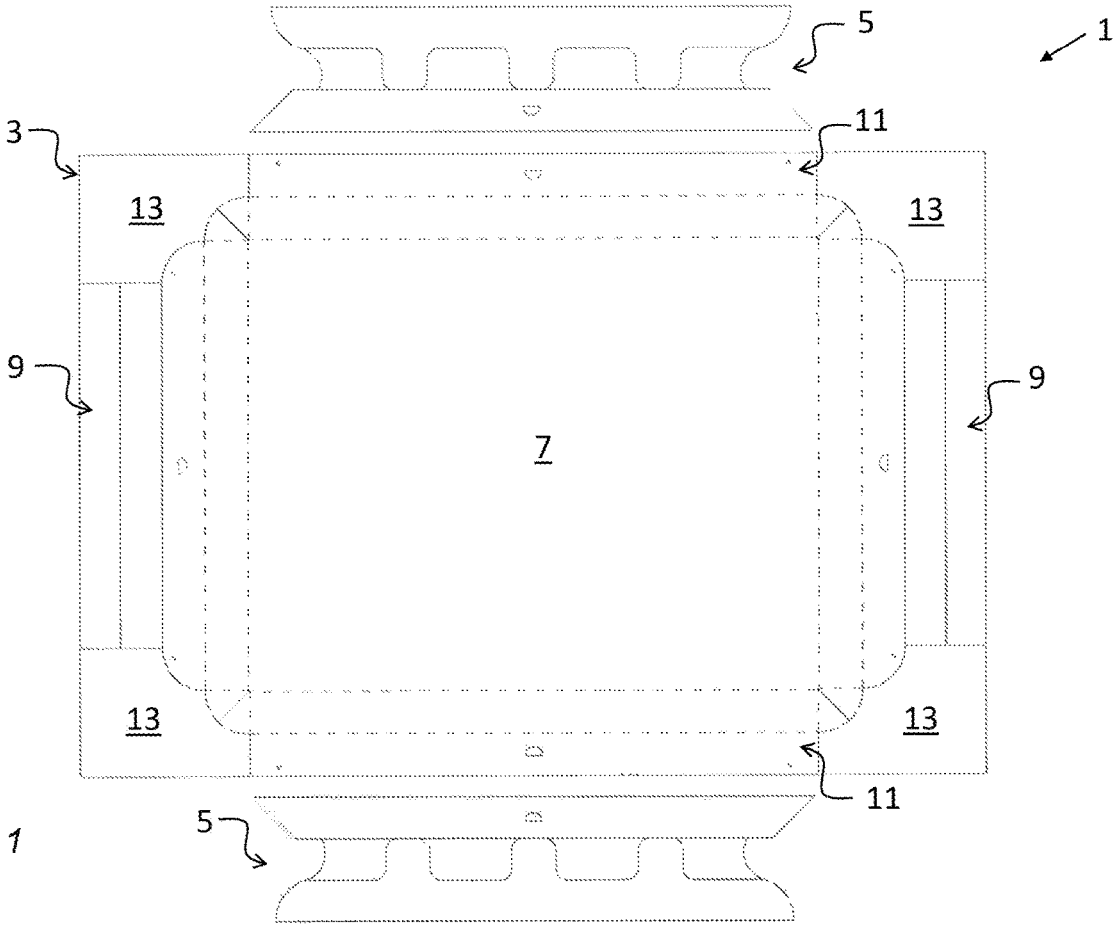
FIG. 1 is a plan view of a kit of parts providing a first embodiment mounting system according to the invention.
Figure 2:
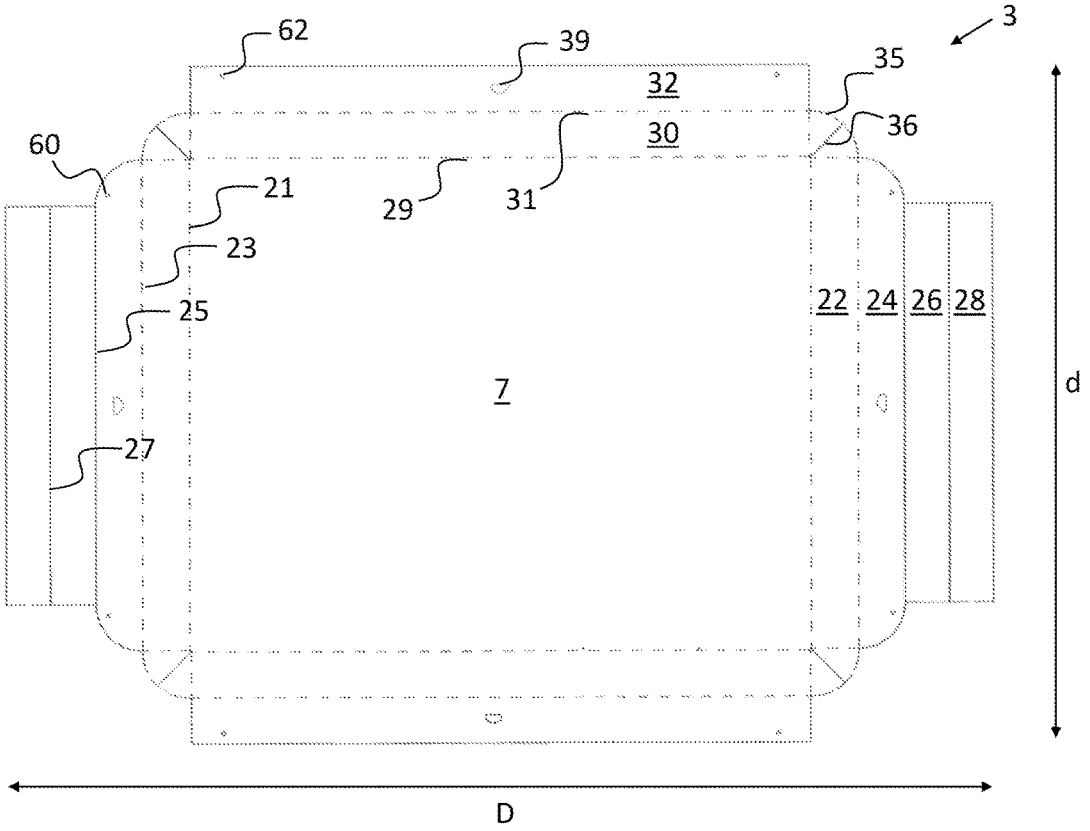
FIG. 2 is a detailed plan view of a main blank part forming part of the FIG. 1 kit.

Referring to FIGS. 1 and 2, there is shown a mounting system 1 of a first embodiment. It comprises a blank 3 of card or other material and two, separate, tab members 5.

The blank 3 is generally rectangular with score marks as shown which mark out various frangible and foldable parts for assembling the system. Corner parts 13, for example, are detachable from the rest of the blank 3 (see FIG. 2) and discarded.

The blank 3 comprises a rectangular central portion 7, shown in FIG. 1 from the rear side, i.e. the side opposite to that which will carry the artwork. On opposite sides of the central portion 7 are a pair of integrally formed tabs 9.

Each tab 9 comprises four fold sections 22, 24, 26, 28 defined by vertical fold lines 21, 23, 25, 27. As will be explained below, the four fold sections 22, 24, 26, 28 are arranged in use to be folded into respective longitudinal box-shapes to provide left and right perimeter members. The length of the first fold sections 22 is substantially the same as that of the central portion 7. The external edges of the second fold sections 24 narrow inwards in an arcuate manner. The length of the third and fourth fold sections 26, 28 is narrower than that of the first and second fold sections 22, 24 as shown.

On the upper and lower sides of the central portion 7 are partially-formed tabs 11, in this case each providing two fold sections 30, 32 defined by horizontal fold lines 29, 31.

Adjacent first fold sections 22, 30 are joined by a rounded, quarter circle portion 35 having a diagonal fold line through its centre. The second fold sections 24, 32 of each tab 9, 11 have small through-holes 60, 62 which, when the fold sections are formed into box sections (as will be explained below) are positioned to overlie one another.

No part of the blank 3 is required to carry adhesive.

Semi-circular holes 39 are provided centrally of each second fold section 24, 32.

It will be noted that the orthogonal dimensions (d×D) are different, and more specifically that dimension d is narrower by virtue of employing only two fold sections 30, 21. This means that a larger print area 7 can be catered for in a given printer or finisher than would be the case had all four fold sections been identical. Any combination of blank dimensions (d×D) can be used, provided one is narrow enough to fit within the printer.

Once the print area 7 has been run through a printer/finisher, the blank can be assembled into a finished mounting system as will be described below.

First, two separate extending tab members 5 are respectively connected to the second fold sections 32, either side of the central area 7.

Figure 3:
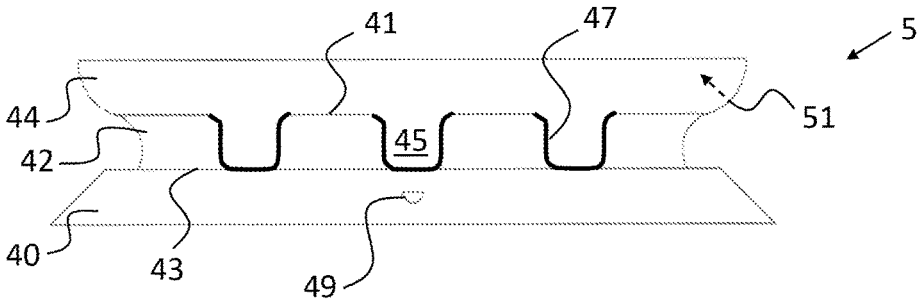
FIGS. 3*a* and 3*b* show a detailed plan view of an extension tab forming part of the FIG. 1 kit in relation to one part of the blank to which it attaches.
Figure 3:
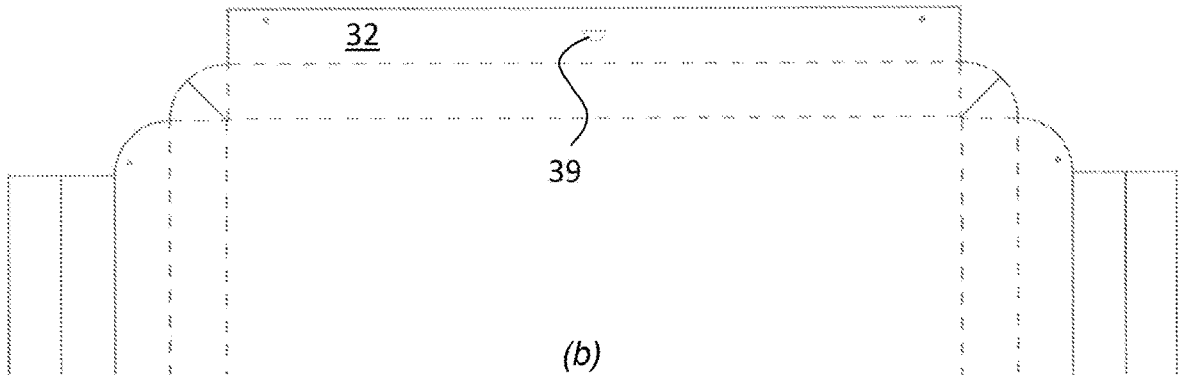

Referring to FIG. 3, which shows only the top side, each extending tab member 5 comprises a planar and longitudinal piece of card divided by parallel fold lines 41, 43 into three fold sections 40, 42, 44. The second fold section 42 is narrower along the horizontal axis as shown, and the terminal edges of all sections curve inwardly to give an overall hour-glass shape. Between the edges of the second fold section 42 are a plurality of push-out tabs 45. The push-out tabs 45 can be of any shape, but here are generally U-shaped. The push-out tabs 45 are defined by partial cut lines 47 so that folding the third fold section 44 relative to the second fold section 42 results in the push-out tabs 45 separating from the surrounding second section.

The rear surface 51 of each separate tab member 5 carries a pressure adhesive, which may initially be covered with a peel-off liner. The adhesive may cover substantially all of the rear surface 51, or discrete parts of it. This adhesive allows its first fold section 40 to be adhered over the second fold section 32 of the main blank 3 with the holes 39, 49 aligned.

Figure 4A:
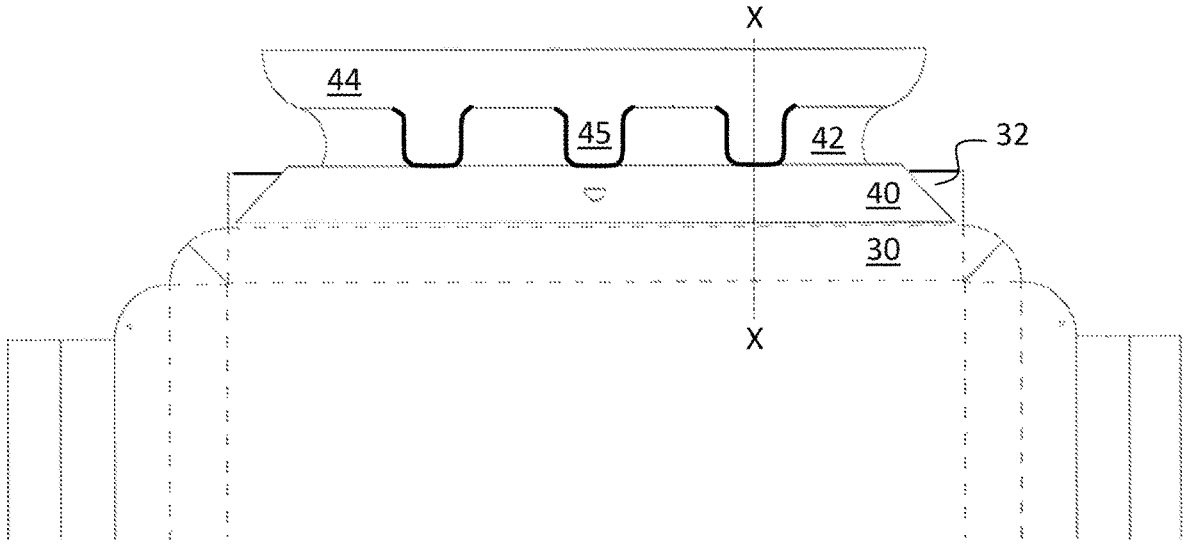
FIGS. 4*a* and 4*b* show in plan and side-sectional views, along axis X-X, the extension tab when connected to the blank.
Figure 4B:
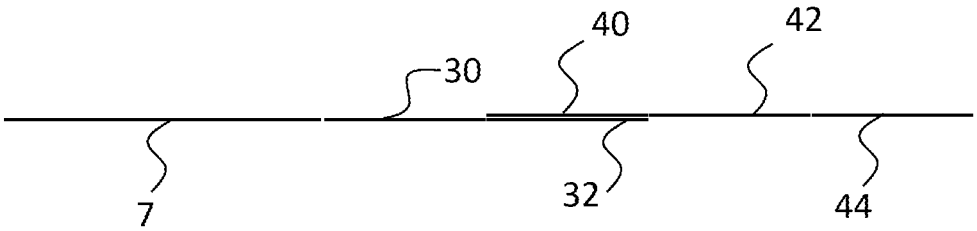

FIGS. 4*a* and 4*b* show the resulting perimeter structure for one side, in plan and side sectional views.

Figure 5A:
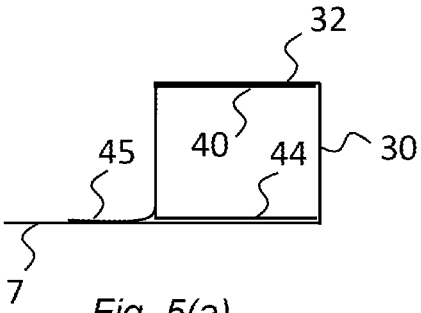
FIGS. 5*a* and 5*b* show in side-sectional and perspective views the extension tab when folded into a three-dimensional shape.
Figure 5B:
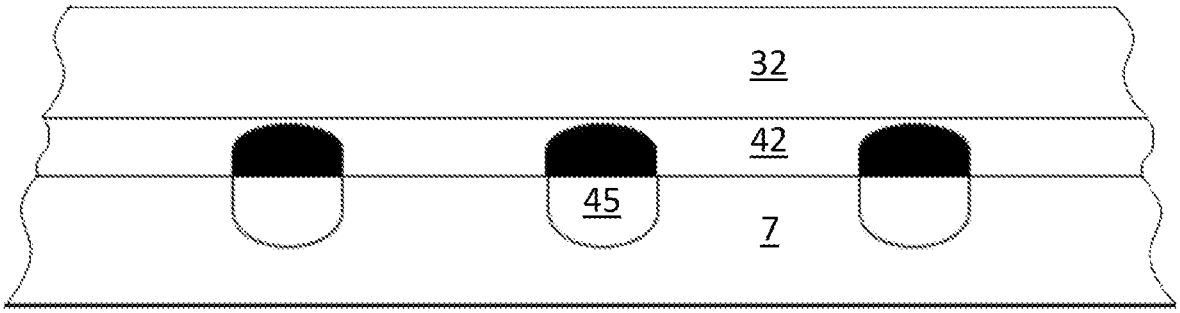

In use, the user then folds each of the fold sections 30, 32 and 40, 42, 44 backwards, relative to their adjacent fold section(s) to form a box-like perimeter member. The adhesive on the rear surface of fold section 44 is then adhered to the edge of portion 7. The push-out tabs 45 are similarly adhered to portion 7 using adhesive, also shown more clearly in FIG. 5*b*.

It should be remembered that fold portion 42 carries adhesive, which is used later on in the process.

Figure 6:
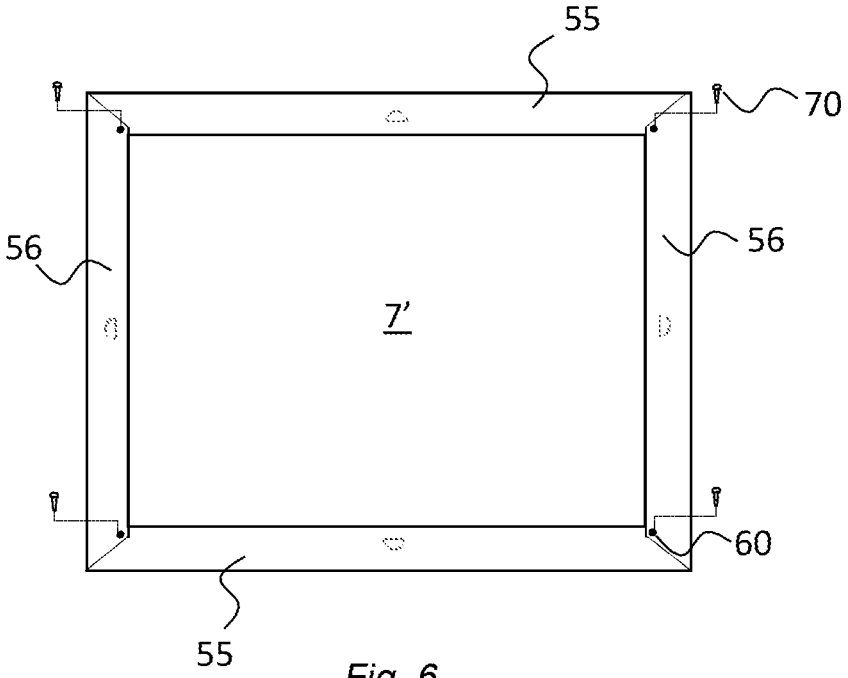
FIG. 6 is a rear plan view of the mounting system when part finished, with each perimeter member formed by folding the tabs attached to the rear of the blank.

Having formed and fixed the upper and lower perimeter members, the user then completes the frame by forming the right and left-hand perimeter members using tabs 9, for which refer back to FIGS. 1 and 2. This is achieved by folding the fold sections 22, 24, 26, 28 backwards to form box-like members in a similar manner. The resulting structure is shown from the rear side in FIG. 6, where the two pairs of perimeter members 55, 56 are indicated.

The through-holes 60, 62 are arranged to overlie in this condition, specifically with fold sections 24 overlying the edges of fold sections 32. The orthogonal perimeter members 55, 56 are then pinned or otherwise fastened together by placing a screw, rivet, plug or pin 70 through the four though-holes 60, 62. No adhesive is required on perimeter members 56; they are held in position by the pins 70 securing them to perimeter members 55.

Figure 7:
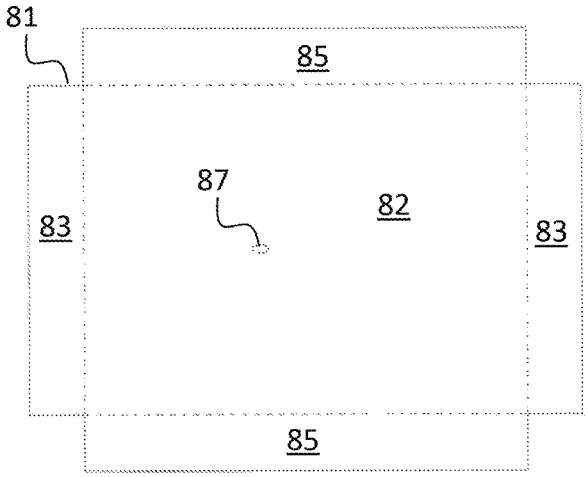
FIG. 7 is a plan view of a stiffening element blank for use with the mounting system.

Finally, and preferably, a box-like stiffener 80 is formed from a blank 81 as shown in FIG. 7. The blank 81 comprises a main section 82 dimensioned substantially the same as the exposed rear surface 7' shown in FIG. 6. Four tabs 83, 85 extend from each perimeter, which fold forwards to form the box. A finger hole 87 enables the stiffener 80 to be inserted and removed.

Figure 8:
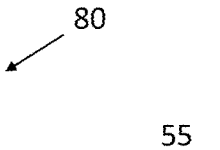
FIG. 8 is a plan view of the stiffening element when placed within the void between the mounting system perimeter members.
Figure 8:
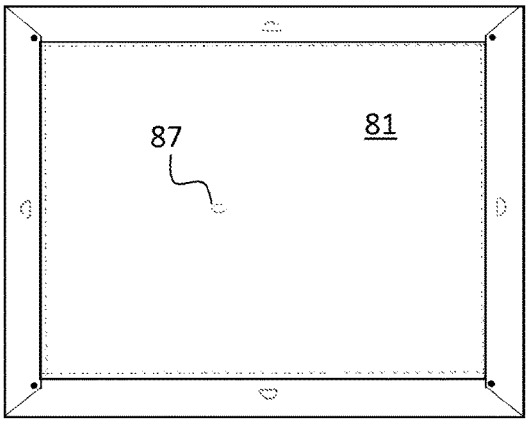

Referring to FIG. 8, to complete the mounting system 1, the stiffener 80 is located within the void between the perimeter members 55, 56. The exposed adhesive on the fold portions 42 adheres to tabs 85 to help fix it in position.

The above-mentioned mounting system has several advantages, as noted. These include allowing a wider range of sizes to be catered for using existing printers. For example, a standard inch printer can cater for a wider range of sizes. Further, less adhesive is needed, with only the separate 'extension' tabs 5 carrying adhesive on one side. Testing has demonstrated a saving of up to 80% compared with current methods. The provision of overlying holes 60, 62 also allow fixing of the perimeter members in a straightforward manner. Overall, the mounting system is straightforward to assemble and manufacture. The mounting system can be assembled at a factory, or even delivered to customers for self-assembly. It can be provided in kit-form with a set of instructions for assembly.

The blank can be formed of any material, including cardboard, laminated board and so on. Example dimensions include:

| Blank Size | Image Size | Tab Depth |
|---|---|---|
| 605 × 457 | 305 × 305 | 38 |
| 656 × 431 | 356 × 279 | 38 |
| 808 × 702 | 508 × 406 | 38 |

It will be appreciated that the above described embodiments are purely illustrative and are not limiting on the scope of the invention as should be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

The invention claimed is:

1. A mounting system for artwork comprising:

a blank of planar material comprising a rectangular main section having each of first and second opposite sides and third and fourth opposite sides, the main section adapted for carrying an artwork; and a plurality of separate extender tabs not part of the blank for attachment to respective opposite sides of the blank, each extender tab being longitudinal and having a plurality of parallel fold lines along its length to enable the extender tab to be folded into a three-dimensional perimeter member and fixed behind the main section of the blank, wherein on each of first and second opposite sides of the main section is integrally formed first and second longitudinal tabs, respectively, extending outwardly from said main section by a dimension W and having a plurality of parallel fold lines to enable the first and second tabs to be folded into a three dimensional perimeter member and fixed behind the main section of the blank, and wherein the plurality of separate extender tabs are arranged to be attached to the third and fourth opposite sides.

2. A mounting system according to claim 1, wherein the main section further comprises, on each of the third and fourth opposite sides, integrally formed third and fourth longitudinal tabs, respectively, having at least one foldable section to which one of the extender tabs can be attached, the extender tabs each having a corresponding extension dimension w, wherein $w<W$.

3. A mounting system according to claim 2, wherein the third and fourth tabs comprise a first foldable section integrally connected to the main section, and a second foldable section integrally connected to the first foldable section to which one of the extender tabs can be attached.

4. A mounting system according to claim 2, wherein the separate extender tabs each comprise two fold lines defining three foldable sections, a first one of the foldable sections being arranged to attach to the foldable section of one of the third and fourth integrally formed tabs.

5. A mounting system according to claim 4, wherein a second, central one of the three foldable sections comprises one or more push-out tabs defined by partial cuts made through, or substantially through, the extender tabs so that relative folding between the second and third sections results in the push-out tabs projecting outwards.

6. A mounting system according to claim 5, wherein one side of each separate extender tab includes an adhesive.

7. A mounting system according to claim 6, wherein the adhesive is provided at least on the first foldable part and the push-out tabs.

8. A mounting system according to claim 7, wherein the adhesive is further provided on the parts of the second foldable section which are either side of the push-out tabs.

9. A mounting system according to claim 1, wherein the first and second tabs each comprise four fold lines defining four fold sections to enable folding of the first and second tabs into a box-like perimeter member, with a substantially rectangular cross section, the fourth fold section being generally parallel with the blank main section.

10. A mounting system according to claim 5, wherein the second foldable sections of each of the extender tabs comprises a hole, arranged such that the holes of adjacent tabs overlie one another when the extender tabs are folded into their three-dimensional shapes.

11. A mounting system according to claim 10, further comprising a pin or a plug dimensioned and arranged to friction fit within the overlying holes to retain first, second and extender tabs in place.

12. A mounting system according to claim 1, further comprising a stiffening element provided in the form of a blank of card with a main, central rectangular section and four perimeter fold tabs, arranged to locate in a friction fit within a void between the first, second and extender tabs.

13. A method of constructing a mounting system for artwork comprising: providing a mounting system according to claim 1; applying an artwork to the main section; attaching the extender tabs to respective sides of the blank; and folding the extender tabs into the three-dimensional perimeter member behind the main section.

14. The method of constructing a mounting system according to claim 13, further comprising: folding each of the first and second tabs backwards to form a three dimensional, box-like shape behind the main section; attaching the extender tabs to the third and fourth foldable tabs using adhesive; and folding first, second and extender tabs backwards to form a three dimensional, box-like shape behind the main section.

* * * * *